United States Patent [19]

Reiseneder

[11] Patent Number: 4,972,952

[45] Date of Patent: Nov. 27, 1990

[54] PHOTOGRAPHIC-SLIDES STORAGE/CARRIER UNIT

[75] Inventor: Ingeborg Reiseneder, Chicago, Ill.

[73] Assignee: The Cloverline, Inc., Chicago, Ill.

[21] Appl. No.: 437,104

[22] Filed: Nov. 16, 1989

[51] Int. Cl.[5] ..... B65D 85/30

[52] U.S. Cl. ..... 206/456; 40/405; 206/450; 206/455; 281/38; 402/79

[58] Field of Search ..... 206/455, 456, 472, 479, 206/450; 40/159, 359, 642, 405; 281/15.1, 38, 40, 51; 402/54, 64, 68, 79

[56] References Cited

U.S. PATENT DOCUMENTS

| | | | |
|---|---|---|---|
| 902,153 | 10/1908 | Logan | 206/456 |
| 1,170,793 | 2/1916 | Ballantine | 281/15.1 |
| 2,296,272 | 9/1942 | De Sherbinin | 40/159 |
| 2,439,868 | 4/1948 | Segal | 281/38 X |
| 2,634,777 | 4/1953 | Berger | 150/147 |
| 2,643,474 | 6/1953 | Grenot | 206/39 X |
| 2,850,294 | 9/1958 | Ortis et al. | 40/159 |
| 3,624,873 | 12/1971 | Frey | 206/456 X |
| 3,797,146 | 3/1974 | Holes | 281/15.1 X |
| 4,629,070 | 12/1986 | Roberg | 206/455 |
| 4,704,042 | 11/1987 | Eisen et al. | 206/455 X |
| 4,940,353 | 7/1990 | Osono et al. | 402/79 |

FOREIGN PATENT DOCUMENTS

| | | | |
|---|---|---|---|
| 848586 | 1/1962 | France | 206/456 |
| 476606 | 9/1969 | Switzerland | 206/455 |
| 1492571 | 11/1977 | United Kingdom | 206/455 |

*Primary Examiner*—Bryon P. Gehman

*Attorney, Agent, or Firm*—Milton S. Gerstein

[57] ABSTRACT

A storage unit for photographic slides which is removably securable to an outer protective jacket, so that the storage unit may be easily removed, which is also provided with a plurality of holes for allowing it to be inserted and retained in a loose-leaf binder or notebook for removable storage. The outer jacket is provided with an interior pocket which snugly receives a stiffened end of the storage unit for accomplishing the easy removal from, or insertion of, the storage unit.

3 Claims, 2 Drawing Sheets

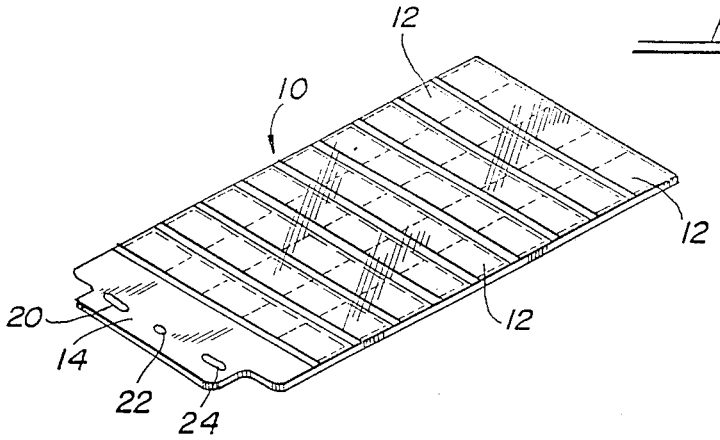
FIG 1
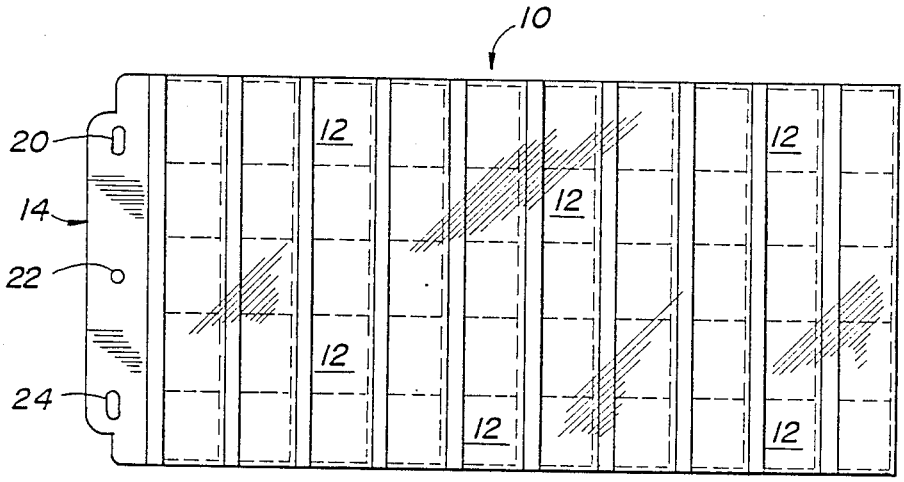
FIG 2
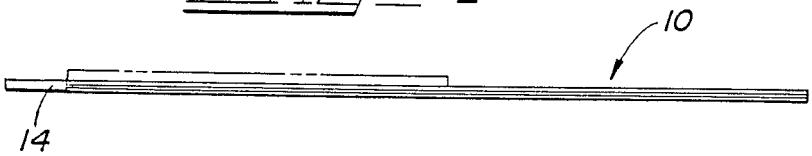
FIG 3
FIG 4
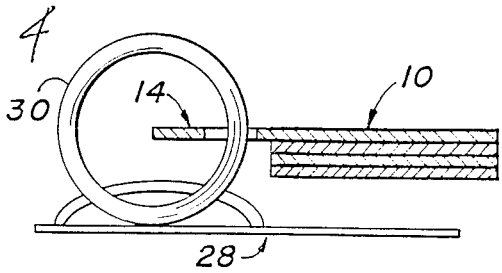

FIG. 5
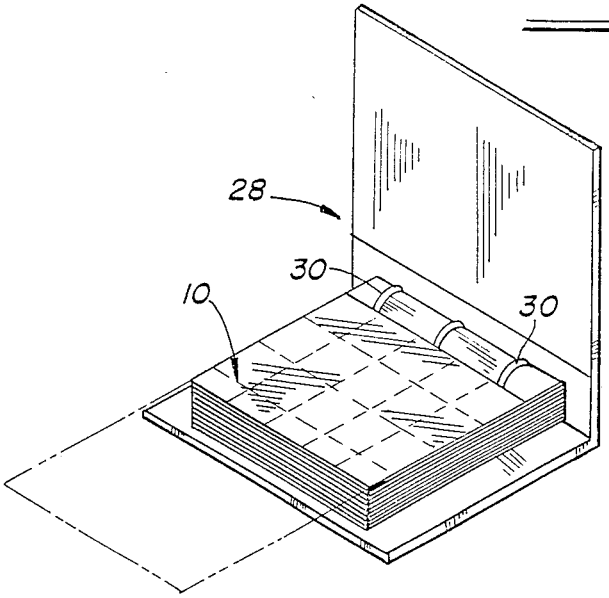
FIG. 6
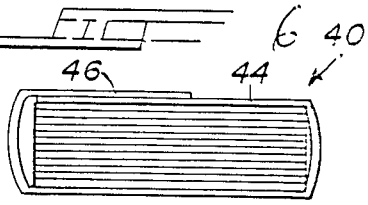
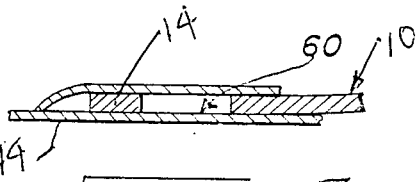
FIG. 7
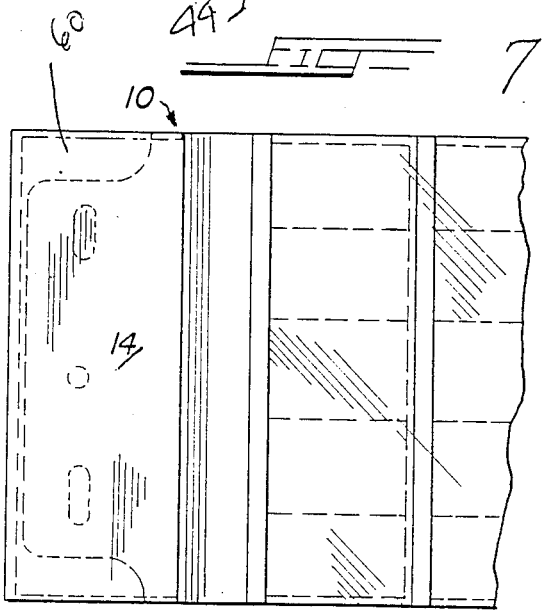
FIG. 9
FIG. 8
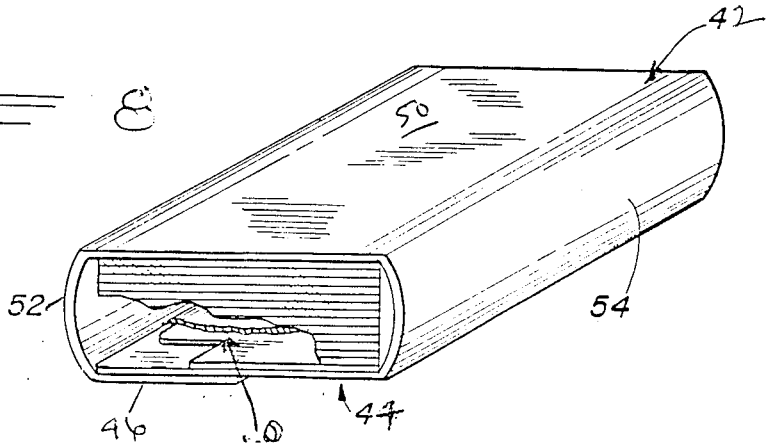

PHOTOGRAPHIC-SLIDES STORAGE/CARRIER UNIT

BACKGROUND OF THE INVENTION

The present invention is directed to a photographic-slides storage and carrier unit. Slides-storage units are known, and typically are made of clear, soft thermoplastic-resin material in which have been formed substantially rectilinear-shaped pockets for storing a series of photographic slides. Each pocket has an open side serving as the entrance for inserting or removing the slide. In addition, such storage units are also provided with a jacket or protective carrier made of hard plastic in which the slide-carrier is inserted and protected during storage and which allows for easy transport of the slide-storage unit. The outer jacket is foldable, so as to be compact during transport. Usually, one end of the storage-unit is fixedly secured to an interior surface portion of the outer jacket, so that the storage unit and protective jacket from one complete and integral product. The outer jacket is provided with conventional, cooperating fasteners on the outer surface thereof, by which the outer jacket is retained in its folded state for storage and transport.

SUMMARY OF THE INVENTION

It is the primary objective of the present invention to provide a slides-storage unit that is removably securable to an outer protective jacket, so that the storage unit may be easily removed.

It is also an objective of the present invention to provide such a slides-storage unit that is provided with a plurality of holes for allowing it to be inserted and retained in a loose-leaf binder or notebook for removable storage therein.

The outer jacket of the invention is provided with an interior pocket which snugly receives a stiffened end of the storage-unit for accomplishing the easy removal from, or insertion into, the storage unit.

BRIEF DESCRIPTION OF THE INVENTION

The invention will be more readily understood with reference to the accompanying drawing, wherein:

FIG. 1 is a perspective showing the slides-storage unit of the invention;

FIG. 2 is a top view thereof;

FIG. 3 is a side view thereof;

FIG. 4 is a side elevational view, in partial cross-section, showing the slides-storage unit emplaced in a loose-leaf binder;

FIG. 5 is a perspective view showing the slides-storage unit mounted in the loose-leaf binder in a folded state along with other like slides-storage units;

FIG. 6 is an end view showing the slides-storage unit in a folded-up state and removably housed in an outer, carrier-unit used for transporting the storage unit;

FIG. 7 is a detail view, in partial cross section, showing the stiffened end of the slides-storage unit inserted in the interior pocket of the outer carrier-jacket for achieving the removably securement of the storage unit thereto;

FIG. 8 is a perspective view of the slides-storage unit in the outer carrier-jacket, partially broken away to show the insertion of the stiffened end of the storage unit in the pocket of the outer carrier-jacket; and FIG. 9 is a top view showing the slides-storage unit in its unfolded, opened-up state.

DETAILED DESCRIPTION OF THE INVENTION

Referring now to the drawings in greater detail, the slides-storage unit is indicated generally by reference numeral 10. Referring to FIGS. 1–6, the storage unit 10 is made of soft, thermoplastic-resin material, and includes a series of rows and columns of pockets 12, as is conventional. According to the invention, the end 14 of the unit 10 is stiffened, and may be made of hard thermoplastic-resin material, which stiffened end allows for easy insertion into a pocket-holder of an outer jacket or carrier, described below in greater detail. The stiffened end 14 is provided with three through-holes or openings, 20, 22, and 24, the outer openings being slots or oval-shaped openings, with the central or middle one being circular. These openings 20–24 allow for the slides-storage carrier 10 to be inserted into a loose-leaf binder 28, as shown in FIGS. 4 and 5, with the binder 28 being conventional and having a plurality of rings or ring-binders 30 by which the slides-carrier unit 10 may be stored therein, as in the manner of loose-leaf paper. By making the outer openings 20, 24 elongated slots, various sizes of binders may be accommodated. This allows for the carrier unit 10 to be stored in one's scrapbook, or the like, and allows for easy removal therefrom when it is desired to carry or transport the carrier unit 10, which transport is achieved via the outer jacket or carrier herein described. This outer jacket or carrier is shown in FIGS. 6–9 and is indicated by reference numeral 40. The outer jacket 40 is substantially similar to prior-art outer jackets or carriers in that it is made of three sections or portions 42, 44, 46. Section 42 is the main or central housing defining a lower wall or surface 50 and a pair of upstanding flexible side walls 52, 54, which are connected to the lower wall 50 by fold lines, so that when not being used, the main section 50 may lie flat. The sections 44, 46 are cover or closure elements, and are respectively connected to the upper edges of the side walls 54, 52 by fold lines, with these closure walls or elements having cooperating closure elements, such as snap-fits, for closing the outer jacket during transport. The above-description regarding the outer jacket is conventional, which conventional outer carrier unit 40 also fixedly secures an end of the storage unit to an interior surface of the jacket, so that the storage unit is fixedly secured in place, and cannot be removed from the jacket. According to the invention, the interior surface of the stiffened closure wall 44 is provided with an enlarged open pocket 60 which slidingly and removably receives therein the stiffened end 14 of the storage unit 10. The pocket 60 may open from the outside, or may, preferably, open from the inside; that is, the enlarged pocket 60 has its opening facing toward the side wall 54. The stiffened end 14 has tapered lateral edge surfaces to aid in the insertion thereof into the enlarged pocket 60, and is first inserted into the pocket 60 when the entire jacket 40 is in its unfolded state. After inserting the end 14, the storage unit 10 is folded on itself accordion-style, in the conventional, prior-art manner, so as to be contained within the boundary of the outer jacket 40, and then the jacket 40 is folded up and closed for subsequent transport. FIG. 1 shows the storage unit 10 after the stiffened end 14 has been removed from the pocket 60 for subsequent insertion into the loose-leaf binder. This removable mounting of the slides-carrier unit 10 allows for its easy removal from and insertion into a loose-leaf binder, as above-described.

While a specific embodiment of the invention has been shown and described, it is to be understood that numerous changes and modifications may be made therein without departing from the scope, spirit and intent of the invention as set forth in the appended claims.

What is claimed is:

1. A storage/carrier unit for photographic slides comprising:

a storage unit made of flexible material to allow for the folding-in on itself and having a series of pockets for storing slides therein;

and a carrier unit made of a stiffer material for receiving therein said storage unit, said carrier unit being foldable along at least two fold-lines and having an interior surface divided into a first main portion between the two fold-lines, a second portion extending from one fold-line outwardly toward a first edge of said carrier unit, and a third portion extending from the other fold-line toward a second edge;

said second and third portions overlapping said first main portion when closing said carrier unit, each of said second and third portions having cooperating means for releasably securing said second and third portions together;

one of said second and third portions of said carrier unit comprising an enlarged pocket having an entrance;

said storage unit comprising a stiffened end thereof for removable insertion into said enlarged pocket of said carrier unit;

said stiffened end comprising inwardly-tapering side edge surfaces to aid in the insertion thereof into said entrance of said enlarged pocket; said stiffened end comprising at least two through-holes for allowing for the insertion of said storage unit into a loose-leaf binder.

2. The storage/carrier unit according to claim 1, wherein said stiffened end comprises three through-holes, a first center hole, and second and third laterally-outward through-slots for allowing insertion into loose-leaf binders of varying size.

3. The storage/carrier unit according to claim 1, wherein said entrance of said enlarged pocket faces inwardly toward said main portion when said carrier unit is opened up into a relatively flat state.

* * * * *